US007921524B2

(12) United States Patent
Maurer

(10) Patent No.: US 7,921,524 B2
(45) Date of Patent: Apr. 12, 2011

(54) RELEASE MECHANISM FOR RELEASING MAGNETICALLY RELEASABLE ANTI-THEFT DEVICES

(76) Inventor: Albert Maurer, Grut (CH)

( * ) Notice: Subject to any disclaimer, the term of this patent is extended or adjusted under 35 U.S.C. 154(b) by 177 days.

(21) Appl. No.: 12/286,451

(22) Filed: Sep. 30, 2008

(65) Prior Publication Data

US 2009/0083951 A1 Apr. 2, 2009

(30) Foreign Application Priority Data

Oct. 1, 2007 (CH) ..... 1518/07

(51) Int. Cl.
*H01F 7/02* (2006.01)

(52) U.S. Cl. ..... 24/303; 335/306

(58) Field of Classification Search ..... 24/303; 335/306, 207; 292/251.5; 220/230; 70/276
See application file for complete search history.

(56) References Cited

U.S. PATENT DOCUMENTS

| | | | | |
|---|---|---|---|---|
| 3,899,762 | A * | 8/1975 | Studders | 335/302 |
| 4,012,813 | A | 3/1977 | Martens et al. | |
| 4,339,853 | A | 7/1982 | Lipschitz | |
| 4,527,310 | A | 7/1985 | Vandebult | |
| 4,531,264 | A * | 7/1985 | Minasy | 70/57.1 |
| 4,603,453 | A * | 8/1986 | Yokoyama | 70/57.1 |
| 5,865,970 | A * | 2/1999 | Stelter | 204/298.19 |
| 5,959,520 | A * | 9/1999 | Stelter et al. | 335/306 |
| 6,023,951 | A * | 2/2000 | Maurer et al. | 70/57.1 |
| 6,084,498 | A * | 7/2000 | Stelter et al. | 335/306 |
| 6,329,895 | B1 * | 12/2001 | Maurer et al. | 335/303 |
| 7,148,777 | B2 * | 12/2006 | Chell et al. | 335/306 |
| 7,352,268 | B2 * | 4/2008 | Wright et al. | 335/229 |
| 7,391,327 | B2 * | 6/2008 | Ho | 340/572.3 |
| 7,423,506 | B2 * | 9/2008 | Terasaki | 335/306 |
| 7,486,165 | B2 * | 2/2009 | Ligtenberg et al. | 335/205 |
| 7,576,654 | B2 * | 8/2009 | Ho | 340/572.3 |
| 7,791,486 | B2 * | 9/2010 | Ho | 340/572.3 |
| 2007/0029889 | A1 | 2/2007 | Dunn et al. | |
| 2008/0246573 | A1 * | 10/2008 | Souder et al. | 335/306 |
| 2008/0246574 | A1 * | 10/2008 | Ho | 335/306 |

FOREIGN PATENT DOCUMENTS

WO WO 00/11686 3/2000

* cited by examiner

*Primary Examiner* — Robert J Sandy
*Assistant Examiner* — Michael Lee
(74) *Attorney, Agent, or Firm* — Weingarten, Schurgin, Gagnebin & Lebovici LLP

(57) ABSTRACT

The present invention describes a release mechanism (1) for releasing magnetically releasable anti-theft devices consisting of a multiplicity of permanent magnets in the form of a Halbach array, which are disposed on a plane. While the highly magnetised top side (10) of the release mechanism (1) is covered by the cover plate (6) on the release side, a base plate (5) used for mounting or support is located on the underside (11) of the release mechanism (1). The permanent magnets encompass a continuous, self-contained frame magnet (2), which is magnetised in an axial direction and has a first recess. Inserted in this first recess is a segmented magnet (3), wherein the individual segments are magnetised perpendicularly to the magnetization direction of the frame magnet (2) and a second recess is left open, in which an axially magnetised magnetic core (4) is inserted.

12 Claims, 5 Drawing Sheets

2
3
20
30
S
N

RELEASE MECHANISM FOR RELEASING MAGNETICALLY RELEASABLE ANTI-THEFT DEVICES

This application claims priority to Swiss Application CH-01518/07 filed on Oct. 1, 2007.

TECHNICAL FIELD

The present invention describes a release mechanism for releasing magnetically releasable anti-theft devices comprising a cover plate on the release side and a base plate used for mounting or support, between which permanent magnets used to release the anti-theft device are disposed.

STATE OF THE ART

For some time now, soft goods in department stores and items such as clothing in boutiques have been protected against theft by anti-theft devices releasably secured to said goods. These anti-theft devices are made up of several parts and in most cases a pin-like securing means is passed through the fabric and located on the other side in a holding means. The releasable connection is a positive-locking and/or non-positive-locking connection between the securing means and the holding means and can, given the type of anti-theft devices of interest here, only be released using a high magnetic field and high magnetic induction.

A release mechanism for releasing anti-theft devices is disclosed in EP0047264, in which a ring magnet and a magnetic disc are spaced from one another vertically, forming a multiplicity of horizontal layers, and bounded vertically by a cover plate and a base plate. The ring magnet and the magnetic disc have different magnetic field strengths and may be made from different materials. The release mechanism has a sandwich-type design in a vertical direction, wherein the magnetic disc lies on the base plate and is surrounded by a steel disc, which also lies on the base plate. The ring magnet lies on the steel disc, spaced away from the magnetic disc vertically. In the hole in the magnetic disc, the magnetic field lines run mainly vertically and therefore axially in the direction of the magnetic disc, so that a force component works predominantly in a vertical direction. If anti-theft devices are passed vertically in the direction of the base plate through the hole in the cover plate and through the hole in the ring magnet, a strong vertical magnetic field takes effect, guaranteeing the release of the anti-theft device.

With the mechanism described above, strong magnetic fields can be achieved in the hole in the ring magnet, by choosing appropriate magnetic materials for the magnetic disc, which are suitable for releasing anti-theft devices from soft goods. The use of a ferromagnetic cover plate with a matching hole through which the anti-theft devices can be guided means that a higher magnetic flux can be achieved in the hole of the ring magnet, so that special anti-theft devices requiring higher magnetic field strengths can also be released.

The design described above has a sandwich-like form in a vertical direction, which produces a corresponding overall height. Thicker magnetic discs and ring magnets are used, depending on the material selected, which means that the height of the overall release mechanism is increased still further. Because the anti-theft device has to be brought close to the highly magnetised magnetic disc, so that the magnetic field is sufficiently great, holes are provided, the diameters of which must be large enough for the anti-theft devices. This design does not therefore guarantee that all anti-theft devices will be capable of being removed, since they vary in diameter.

DESCRIPTION OF THE INVENTION

The object of the present invention is to create a mechanism for releasing magnetically releasable anti-theft devices, which has a vertically single-layer, flat design, can be produced easily and with material savings and can be countersunk into the counter top or similar alongside the cash till in a particularly space-saving manner.

These objects are solved by a releasing mechanism according to the features of patent claim 1, while at the same time guaranteeing magnetic fields that are high enough to release standard anti-theft devices and anti-theft devices requiring higher magnetic fields for their release.

Further advantageous embodiments of the releasing mechanism according to the invention are listed in the dependent patent claims.

BRIEF DESCRIPTION OF THE DRAWINGS

The invention is described below in conjunction with the drawings.

FIG. 1 shows a top view of the top side of a releasing mechanism according to the invention without a cover plate, while

FIG. 2 shows a top view of the top side of another rectangular embodiment of the releasing mechanism.

DESCRIPTION

There follows a description of a release mechanism 1 based on a Halbach array, which displays a strongly magnetic top side 10 and a weakly magnetic underside 11. The special property of the Halbach array is that a suitable configuration of permanent magnets causes the magnetic field to be concentrated on the highly magnetic top side 10, while on the underside 11, which is opposite the top side 10, virtually no magnetic field lines emerge from the Halbach array, so that only a weak magnetic field can be measured close to the underside 11.

By attaching a ferromagnetic base plate 5, the surplus magnetic field is bound to the underside 11, which causes a reduction in field emissions on the underside 11 with an unbalanced configuration of magnets and slightly strengthens the magnetic field on the top side 10. In this case, the underside 11 displays roughly ¼ the magnetic field of the top side 10.

Figure 3:
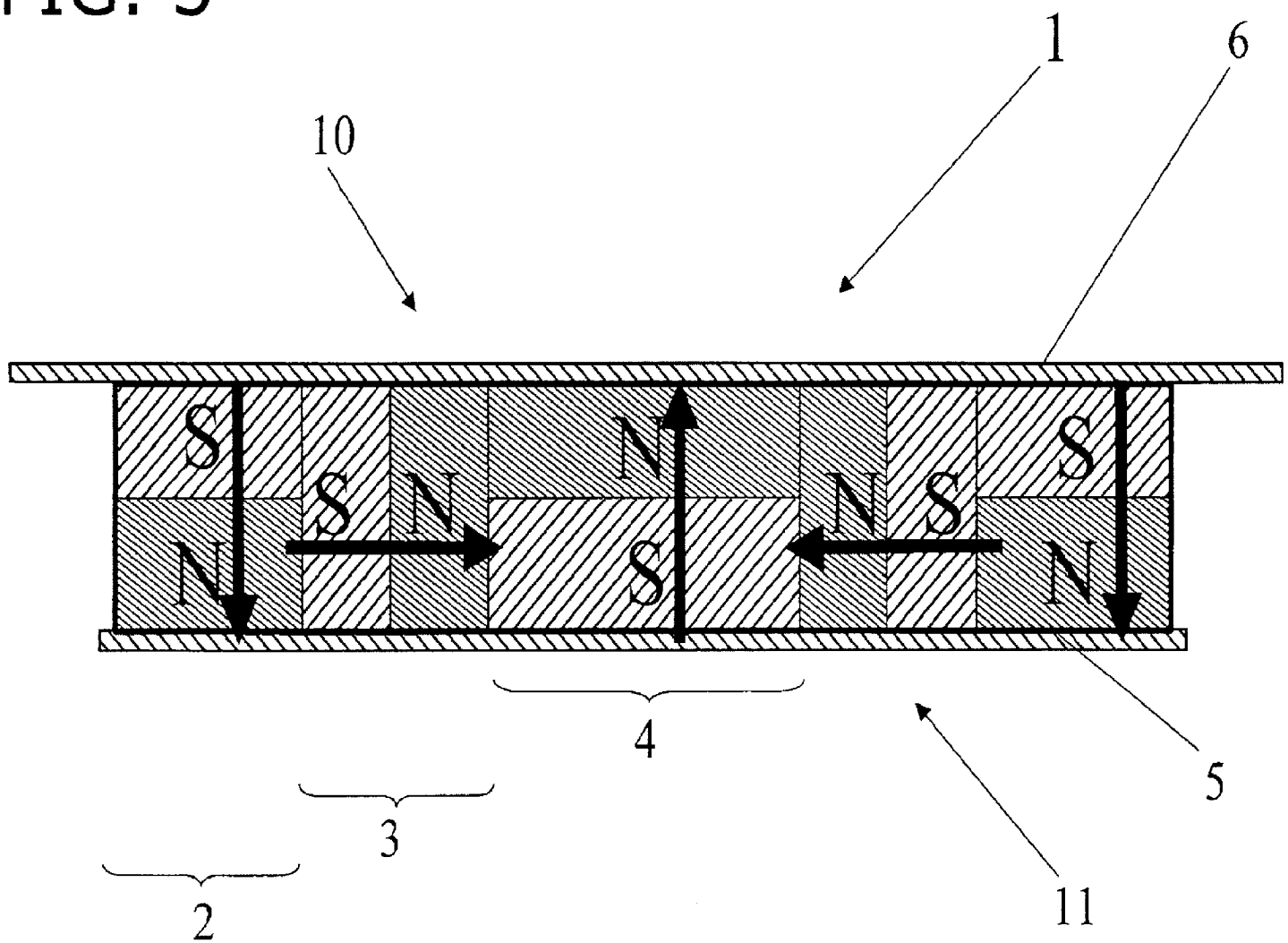
FIG. 3 shows a sectional drawing of the release mechanism with base plate and cover plate, wherein the North and South Poles of each of the permanent magnets are indicated.
Figure 4:
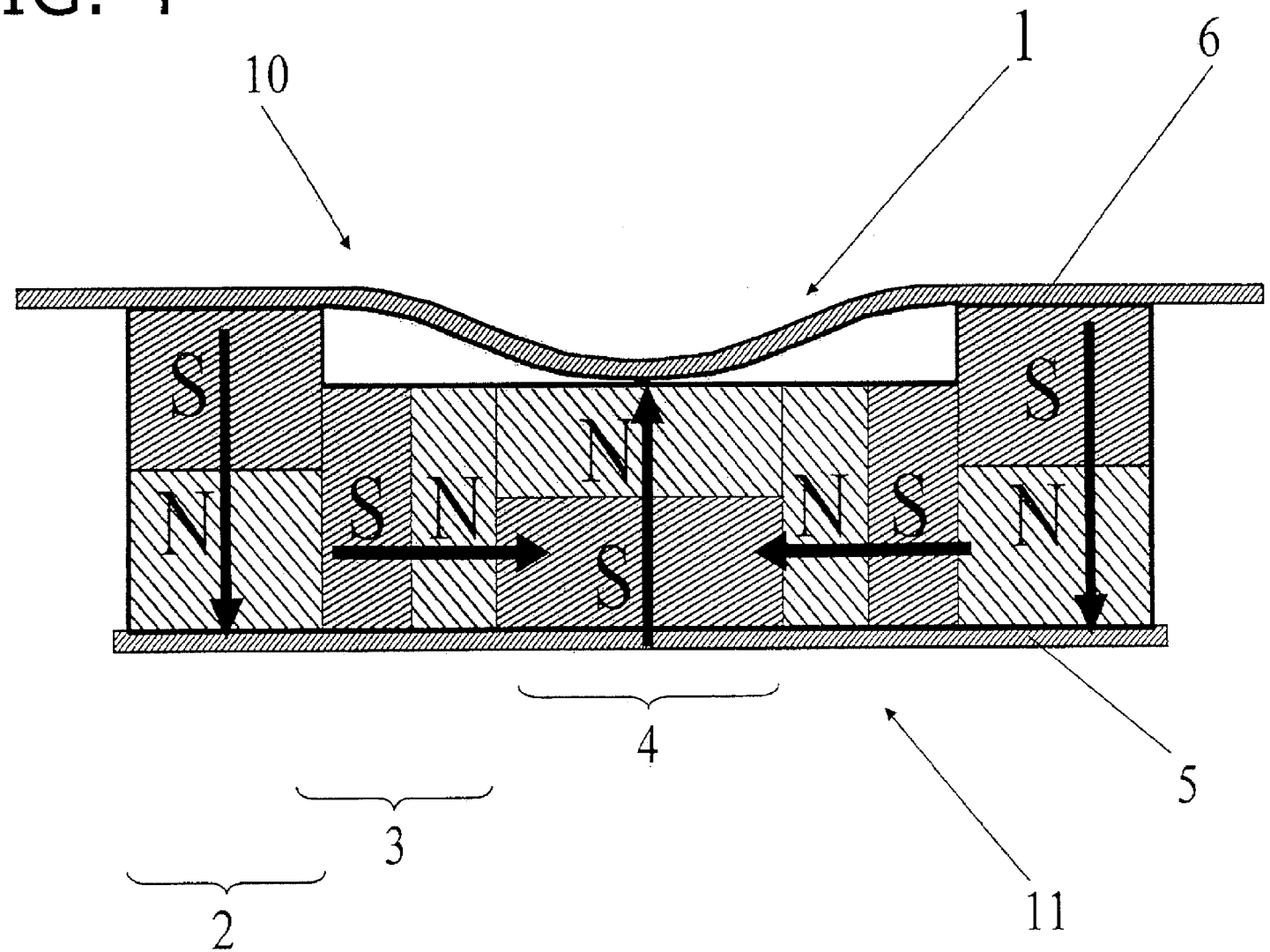
FIG. 4 shows a sectional drawing of a release mechanism according to the invention, wherein the release mechanism has a cavity in the highly magnetic top side.
Figure 5:
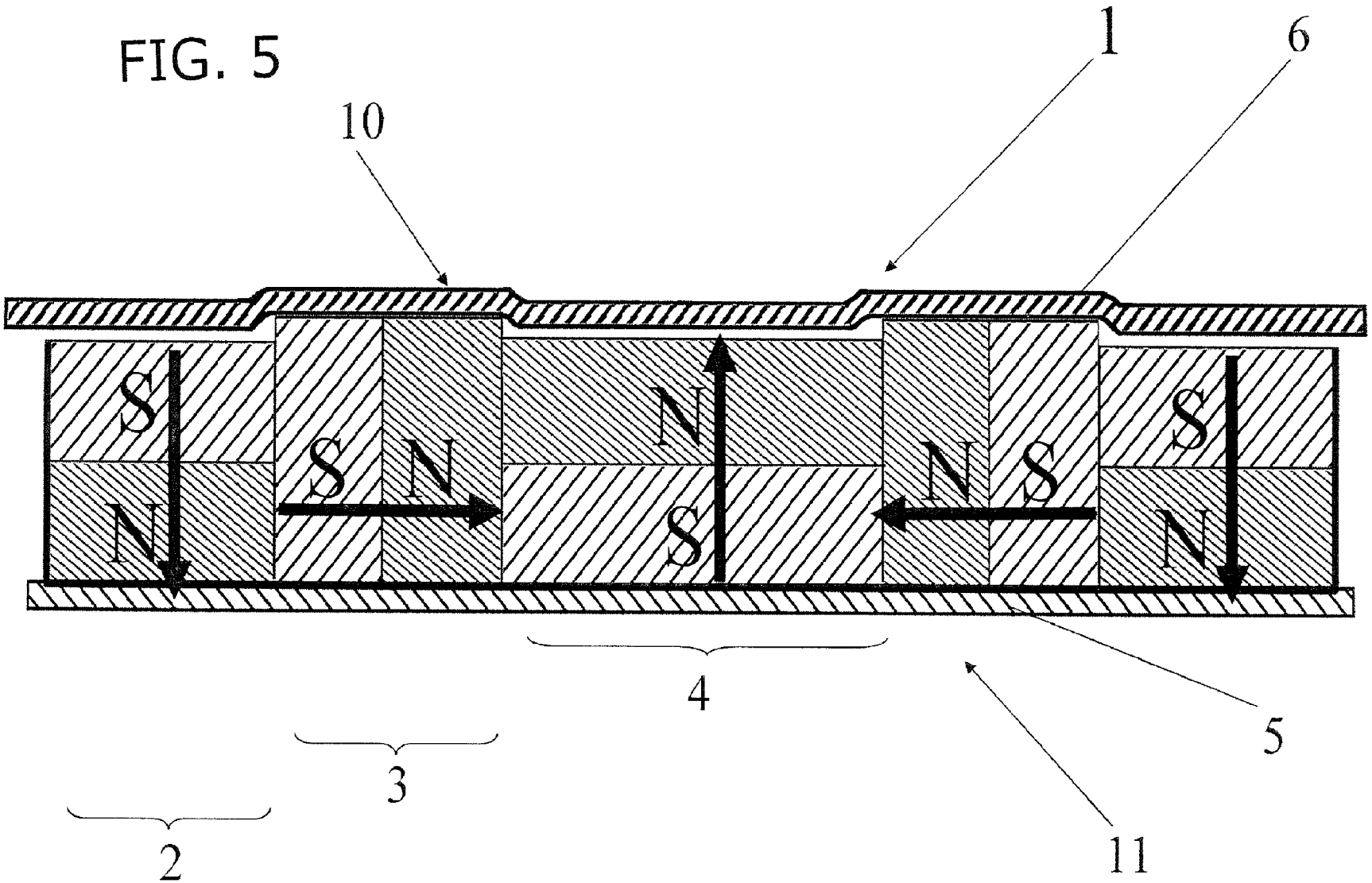
FIG. 5 shows a sectional drawing of a release mechanism according to the invention wherein the segmented magnet has a vertical height greater than that of the frame magnet and the magnetic core.

As can be seen in FIG. 3, the release mechanism 1 is made up of a multiplicity of permanent magnets, which are disposed adjacent to one another and inserted in one another on a plane, wherein the magnetisation directions of directly adjacent permanent magnets are arranged in planes lying roughly perpendicular to one another.

As is customary in physics, the magnetisation direction of the individual permanent magnets is indicated by an arrow, the head of which points to the magnetic North Pole of the permanent magnet concerned. Following this convention, a representation of the magnetisation directions of the individual permanent magnets is obtained, as indicated in FIG. 3. The magnetic North Poles and magnetic South Poles in each case are referred to as N and S in the figures.

The release mechanism 1 for releasing magnetically releasable anti-theft devices has a cover plate 6, which covers the release side on the highly magnetic top side 10. The opposite underside 11 is covered by a base plate 5 acting as a mount or support. Between the cover plate 6 and the base plate 5 there is at least one continuous, self-contained frame magnet 2, which has a first recess 20.

Figures 1, 2:
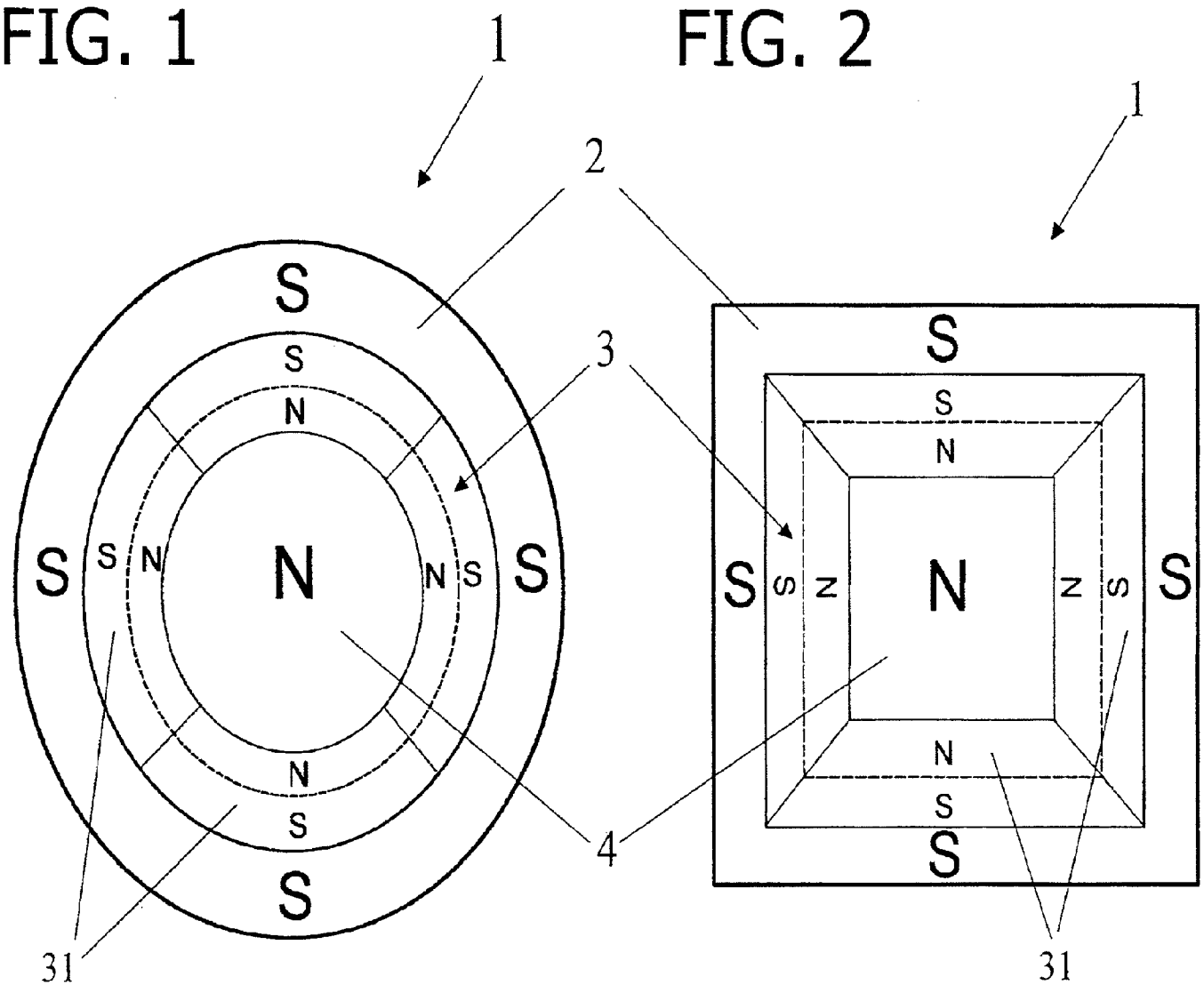
Figures 1A, 1B:
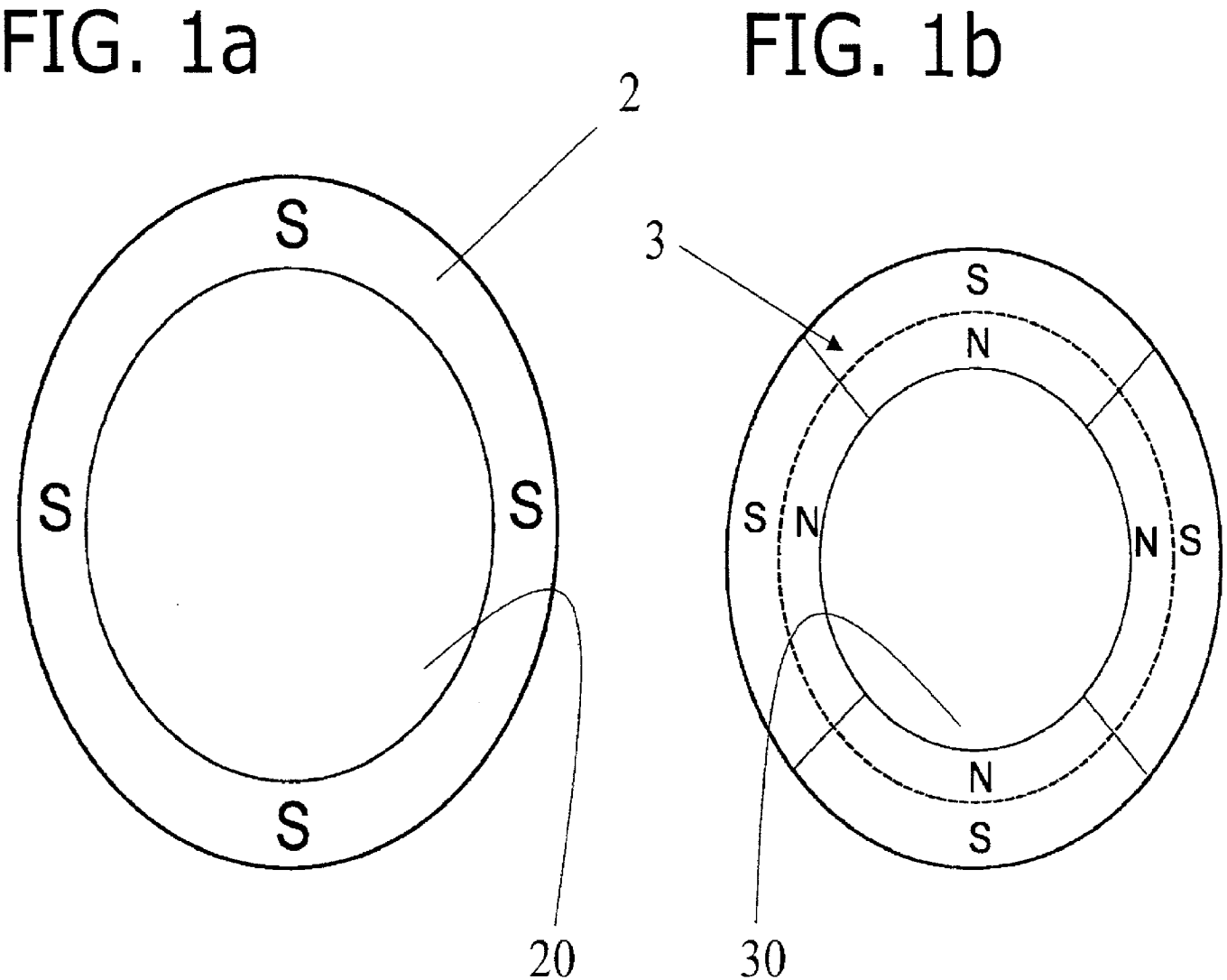
FIG. 1*a* shows a top view of the frame magnet with a recess and FIG. 1*b* shows a top view of the segmented magnet with a second recess and segments.

While a ring-shaped frame magnet 2 is depicted in FIG. 1*a*, FIG. 2 shows a rectangular frame magnet 2. The magnetisation direction of the at least one frame magnet 2 is roughly perpendicular to the datum plane and therefore roughly parallel to the centre axis of the ring-shaped or rectangular frame magnet 2. The line connecting the North and South Poles is roughly perpendicular to the datum plane, while the North Pole points to the underside 11 of the release mechanism 1. In the first recess 20 a segmented magnet 3 is inserted flush with the frame magnet 2, the magnetisation direction of which runs roughly perpendicular to the magnetisation direction of the frame magnet 2 and therefore roughly parallel to the datum plane. According to the invention, the frame magnet 2 and the segmented magnet 3 lie on the same plane, due to the countersinking of the segmented magnet 3, which results in a flat structure.

The segmented magnet 3 consists of a multiplicity of segments 31 and has a second recess 30. By way of example, the two possible embodiments illustrated here show segmented magnets 3, each with four segments 31, wherein the South Poles of the individual segments 31 lie against the inner wall of the first recess 20 of the frame magnet 2, while the North Poles of the individual segments 31 face the second recess 30.

A magnetic core 4 is secured within the second recess 30 of the segmented magnet 3, again on the same plane as the frame magnet 2 and the segmented magnet 3. The magnetic core 4 has a magnetisation direction roughly parallel to its centre axis, while the vector arrow of the magnetisation direction points to the top side 10 of the release mechanism 1. Unlike the frame magnet 2, the magnetic North Pole of the magnetic core 4 therefore points towards the top side 10 of the release mechanism.

In order to achieve the maximum possible magnetic field strengths, it is advantageous for the magnetisation directions of the frame magnet 2 and the segments 31 of the segmented magnet 3 to be aligned precisely perpendicular to one another. If the magnetisation direction of the frame magnet 2 and the magnetic core 4 are aligned at 180° in opposite directions and the magnetisation directions of the individual segments 31 are disposed perpendicular to the magnetisation directions of the frame magnet 2 and the magnetic core 4, a release mechanism 1 is produced with a strong magnetic side and a weak magnetic side.

The configuration of the individual permanent magnets described here produces a stronger magnetic field close to the top side 10 of the release mechanism 1, while the strength of the magnetic field close to the underside 11 of the release mechanism 1 is negligible. There is a quasi strengthening of the magnetic field of the entire release mechanism 1 close to the top side 10, which leads to magnetic flux densities of over one tesla, depending on the dimensions and permanent magnetic material chosen. These attainable flux densities mean that virtually any magnetically held and releasable anti-theft device currently in circulation can be released.

In order to achieve the most homogeneous distribution possible of the magnetic field lines and therefore the magnetic flux densities, the first recess 20 and the second recess 30 should each be applied centrally in the frame magnet 2 and in the segmented magnet 3. Optimum results were achieved using the ring-shaped frame magnet 2 and a central first recess 20 in the form of a cylindrical hole and a central second recess 30 in the segmented magnet 3, which are depicted in FIGS. 1*a* and 1*b*.

The configuration and attachment of the permanent magnets is problematic, since correspondent magnetic poles of adjacent permanent magnets are overlaid in some cases, as a result of which very large repulsive forces sometimes occur. In order to stabilise the release mechanism 1, the frame magnet 2, the segmented magnet 3 and the magnetic core 4 may be bonded onto the base plate 5 and non-detachably connected to the latter. The individual segments 31 are bonded to the inner surfaces of the frame magnet 2 in the first recess 20 for stabilisation purposes. In order to protect the highly magnetic top side 11 of the release mechanism 1, the cover plate 6 is secured non-detachably to the top side 10, so that a compact, single-layer release mechanism 1 made up of permanent magnets results, which can be countersunk in a counter top, for example. In order to bond the individual permanent magnets, two epoxy resin components may, for example, be used.

The use of highly magnetic materials such as samarium-cobalt, neodymium iron boron and aluminium nickel cobalt and future magnetic materials with a high remanence makes it possible to reduce the thickness of the release mechanism 1, which means that release mechanisms 1 in disc form measuring between 15 mm and 10 mm are possible. Both the cover plate 6 and the base plate 5 are made from chrome steel and are used not only for design purposes, but also to protect the permanent magnets. Neodymium iron boron is preferably used for the release mechanisms disclosed here.

If the vertical design height of either the frame magnet 2 or the segmented magnet 3 is selected to be correspondingly greater than the design height of the magnetic core 4, so that the other permanent magnets project beyond the magnetic core 4 towards the top side 10, a cavity is created on the highly magnetic top side 10, which means that the magnetic field on the top side 10 is further increased by roughly 10 to 20% compared with the flat design.

While a segmented magnet 3 comprising four segments 31 has hitherto been described above in a preferred embodiment, it is likewise possible that only a ring-shaped segment 31 forms the magnet 3. In order to produce a release mechanism according to the invention, the number of segments 31 must be at least one.

REFERENCE LIST

1 Release mechanism
- 10 top side (strongly magnetic)
- 11 underside (weakly magnetic)

2 Frame magnet
- 20 first recess

3 Segmented magnet
- 30 second recess
- 31 segment

4 Magnetic core

5 Base plate

6 Cover plate

The invention claimed is:

1. A release mechanism for releasing magnetically releasable anti-theft devices comprising a cover plate on a release side and a base plate used for mounting or support, between which permanent magnets used to release the anti-theft device are disposed, the release mechanism comprising: a continuous, self-contained frame magnet that is magnetised in an axial direction and that has a first recess;

a segmented magnet that is disposed within the first recess of the frame magnet, the segmented magnet providing a second recess, at least one segment of the segmented magnet is magnetised in a radial direction; and a magnetic core that is axially magnetized and disposed within the second recess of the segmented magnet to provide a single-layer of permanent magnets.

2. The release mechanism according to claim 1, characterised in that the frame magnet, the segmented magnet and the magnetic core are non-detachably secured to the base plate.

3. The release mechanism according to claim 1, characterised in that the frame magnet, the segmented magnet and the magnetic core are circular disc-shaped.

4. The release mechanism according to claim 1, characterised in that the first recess and the second recess are holes with circular cross-sectional areas.

5. The release mechanism according to claim 1, characterised in that the segmented magnet comprises at least one segment.

6. The release mechanism according to claim 1, characterised in that the cover plate projects beyond the dimensions of the frame magnet, as a result of which the release mechanism is inserted in a recess and can be secured in a positive-locking manner.

7. The release mechanism according to claim 1, characterised in that the design height of the frame magnet is selected to be greater than the design heights of the segmented magnet and the magnetic core.

8. The release mechanism according to claim 1, characterised in that the design height of the segmented magnet is selected to be greater than the design height of the frame magnet and the magnetic core.

9. The release mechanism as recited in claim 1, wherein the segmented magnet is disposed within the first recess flush with the frame magnet so that upper surfaces of said segmented magnet and said frame magnet provide a flat, planar surface.

10. The release mechanism as recited in claim 1, wherein the segmented magnet includes a plurality of magnet segments that are arranged against an inner, peripheral wall of the frame magnet within the first recess.

11. The release mechanism as recited in claim 10, wherein the magnet segments are structured and arranged with respect to one another to provide a continuous annular or rectangular arrangement.

12. The release mechanism as recited in claim 1, wherein the magnetic core is disposed within the second recess flush with the frame magnet so that upper surfaces of said segmented magnet and said magnetic core provide a flat, planar surface.

* * * * *